United States Patent [19]

Siegfried, II et al.

[11] Patent Number: 4,928,759

[45] Date of Patent: May 29, 1990

[54] TUBING CONVEYED WELLBORE FLUID FLOW MEASUREMENT SYSTEM

[75] Inventors: Robert W. Siegfried, II, Richardson; Lonnie J. Smith, Allen; H. Mitchell Cornette, Plano, all of Tex.

[73] Assignee: Atlantic Richfield Company, Los Angeles, Calif.

[21] Appl. No.: 305,250

[22] Filed: Feb. 1, 1989

[51] Int. Cl.[5] ..... E21B 43/119

[52] U.S. Cl. ..... 166/65.1; 166/66.5; 166/385

[58] Field of Search ..... 166/250, 385, 65.1, 166/66, 66.5; 324/324, 325; 73/151

[56] References Cited

U.S. PATENT DOCUMENTS

| | | | |
|---|---|---|---|
| 4,574,892 | 3/1986 | Grigar et al. | 166/385 X |
| 4,664,189 | 5/1987 | Wittrisch | 166/250 |
| 4,685,516 | 8/1987 | Smith et al. | 166/65.1 |
| 4,690,214 | 9/1987 | Wittrisch | 166/65.1 X |
| 4,729,429 | 3/1988 | Wittrisch | 166/65.1 |
| 4,787,446 | 11/1988 | Howell et al. | 166/66.4 |

OTHER PUBLICATIONS

Production Logging—The Key to Optimum Well Performance; Wade et al.; Feb. 1965.

*Primary Examiner*—William P. Neuder
*Attorney, Agent, or Firm*—Michael E. Martin

[57] ABSTRACT

A fluid flow measuring or so-called production logging instrument for fluids produced in a well includes an inflatable packer for forming a seal in the wellbore to require diversion of wellbore fluid through a passage formed in the instrument whereby fluid flow rate and other fluid properties may be measured. The inflatable packer receives pressure fluid from the tubing string and may be remotely controlled to inflate and deflate, at will, through signals conducted from the surface to the instrument by way of a cable extending through the tubing string. The instrument includes a main wellbore fluid flow passage in which a shutoff valve is disposed for controlling the flow of fluid through the passage and which may be automatically closed or opened in response to actuation of the packer seal.

9 Claims, 2 Drawing Sheets

TUBING CONVEYED WELLBORE FLUID FLOW MEASUREMENT SYSTEM

BACKGROUND OF THE INVENTION

Field of the Invention

The present invention pertains to a wellbore fluid flow or production logging system which is conveyed into and out of the wellbore and controlled by coilable tubing having a wireline type cable disposed therein.

BACKGROUND

It is often necessary to evaluate the type of fluid and the fluid flow rate entering a wellbore at different intervals to evaluate reservoir performance. A publication entitled: "Production Logging—The Key to Optimum Well Performance" by R. T. Wade et al, *Journal of Petroleum Technology*, February 1965, Society of Petroleum Engineers, Richardson, Texas, describes a combination inflatable packer and flowmeter for evaluating the flow of wellbore fluids at selected intervals of production from a reservoir. This type of logging device utilizes wellbore fluid to inflate a bladder to pack off a zone of the wellbore from which fluid flow and the fluid density are measured by suitable instruments associated with the packer. A turbine or spinner-type flowmeter is utilized due to the wide range of liquid-to-gas ratios of the wellbore fluid and the presence of abrasive materials that are carried along with the wellbore fluid.

Utilizing wellbore fluid to inflate a pack-off element may be disadvantageous due to the quantities of contaminants or abrasive materials entrained with the fluids and often due to the composition of the wellbore fluid itself. Still further, damage to a fully diverting type flowmeter in a production logging instrument may easily be encountered during insertion and removal of the logging instrument with respect to the wellbore, or in the event of loss of control of the flow of wellbore fluid through the logging instrument.

The development of coilable tubing systems in which a multiconductor cable or wireline is disposed and through which control fluids may be pumped provides for certain advantages in the operation of downhole tools and instruments. U.S. Pat. No. 4,685,516 to L. J. Smith et al and assigned to the assignee of the present invention describes some features of an improved coilable tubing system for operating downhole tools such as logging instruments. U.S. Pat. No. 4,787,446 to E. P. Howell et al and also assigned to the assignee of the present invention describes an inflatable packer and fluid flow control device adapted for use with coilable tubing systems having multiconductor cable extending therethrough. The present invention utilizes certain features of the improved devices described in the above-mentioned patents while providing a unique production logging instrument in combination with a packer operated by fluid and control signals transmitted through a coiled tubing and wireline type cable combination generally of the type described in U.S. Pat. No. 4,685,516.

SUMMARY OF THE INVENTION

The present invention provides an improved instrument for insertion in a wellbore for measuring the flow rate as well as certain other characteristics of fluids being produced through the wellbore. In accordance with an important aspect of the present invention, there is provided a so-called production logging instrument which is operable in combination with an inflatable packer wherein the assembly of the packer and the logging instrument is connected to a length of coilable tubing for insertion in and traversal through a wellbore, and wherein a multiconductor cable extends through the tubing and both fluid flow control functions and electrical signals are transmitted within the tubing.

In accordance with another aspect of the present invention, a wellbore production logging instrument is provided wherein an inflatable packer may be controlled from the surface by actuation of a pack-off element or bladder using uncontaminated fluid which is pumped downhole to the packer through a tubing string, said tubing string preferably including electrical cable means extending therethrough.

In accordance with yet another aspect of the present invention, a combination production logging instrument and wellbore seal or packer apparatus is provided as a system and which includes a remotely controllable wellbore fluid flow shutoff valve for controlling fluid flow through the instrument.

The above described advantages and superior features of the present invention together with other aspects thereof will be further appreciated by those skilled in the art upon reading the detailed description which follows in conjunction with the drawing.

DESCRIPTION OF PREFERRED EMBODIMENTS

Figure 1:
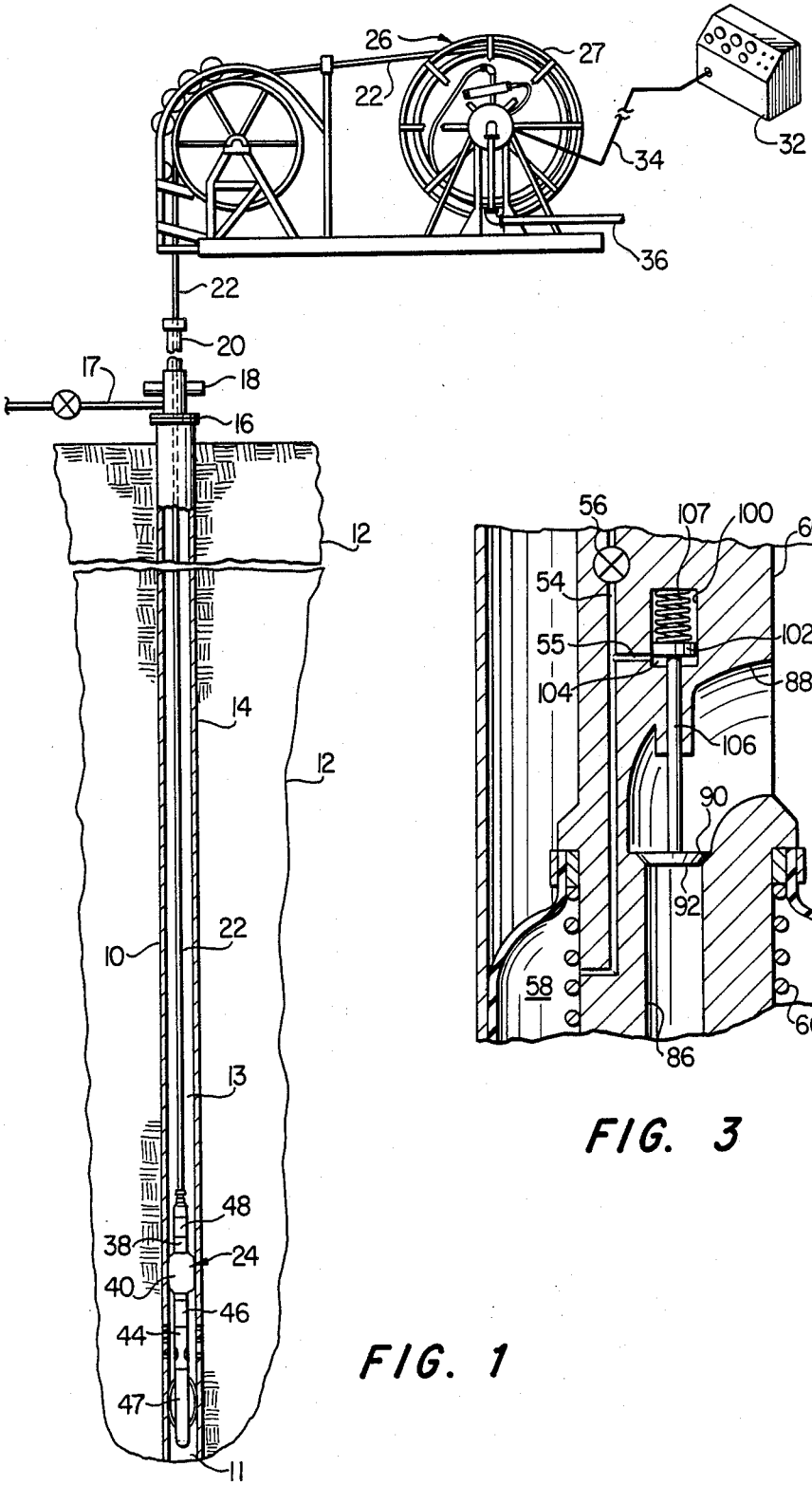
FIG. 1 is a schematic view of the system of the present invention showing a coiled tubing injection unit operating in conjunction with a fluid flow measuring or production logging instrument.

In the description which follows, like parts are marked throughout the specification and drawing with the same reference numerals, respectively. The drawing figures are generally in somewhat schematic form in the interest of clarity and conciseness.

Referring to FIG. 1, there is illustrated a wellbore 10 penetrating an earth formation 12 and constructed in accordance with conventional practices in the oil and gas industry. The wellbore 10 includes a casing 14 which extends to a wellhead 16 having a suitable blowout preventer 18 and a wireline lubricator 20 disposed thereon. A coilable metal tubing 22 extends through the wellhead 16 into the wellbore 10 and is connected to a unique fluid flow measuring or production logging instrument, generally designated by the numeral 24. The tubing 22 is injected into and retrieved from the wellbore 10 by a coiled tubing injection unit 26 which may be of conventional construction and is adapted to provide for a multiconductor electrical cable extending through the tubing 22 as shown in FIG. 2 and indicated by the numeral 30.

The cable 30 is suitably connected to a control and information receiving unit 32 by way of a conductor 34 and utilizing structure associated with the coiled tubing injection unit which is described in more detail in U.S. Pat. No. 4,685,516. In like manner, pressure fluid may be injected into the tubing 22 by way of a conduit 36, as shown in FIG. 1, associated with the coiled tubing injection unit and its tubing storage reel 27. Structural details of the connection between the conduit 36 and the tubing 22 are also described in U.S. Pat. No. 4,685,516, by way of example. Suffice it to say that pressure fluid may be injected into the tubing 22 for operation of certain apparatus associated with the instrument 24 and command and information signals may be transmitted through the cable 30 between the control and data retrieval unit 32 and the instrument 24.

As further illustrated in FIG. 1, the instrument 24 includes a packer 38 having a fluid pressure actuated seal member 40 comprising a flexible sleeve for sealing a space 11 in the wellbore 10 from communicating fluid directly upward through the wellbore into the space 13. The packer 38 provides for conducting wellbore flow from the space 11 through the instrument 24, before its entry into the space 13 for production through the wellhead and a flow line 17, so that the flow rate of fluid entering the wellbore from certain zones of the formation 12 may be determined as well as the composition of the fluid being produced into the wellbore space 11 from such zones. In this regard the instrument 24 includes a fluid flowmeter section 44, which will be described in further detail, together with a section 46 for analyzing certain characteristics such as the composition of the wellbore fluid. The instrument 24 further includes a section 48 which may contain certain control and information handling and storage units for operating the different components of the instrument 24. A tail sub 47 is provided with a conventional centralizer mechanism for centering the instrument 24 in the wellbore 10. Those skilled in the art will appreciate that the instrument 24 may be lowered into the wellbore 10 by way of the tubing 22 and placed in various selected positions in the wellbore followed by actuation of the packer 38 to sealingly engage the wellbore wall so that the flow characteristics and composition of fluid may be measured at selected intervals in the formation 12.

Figure 2:
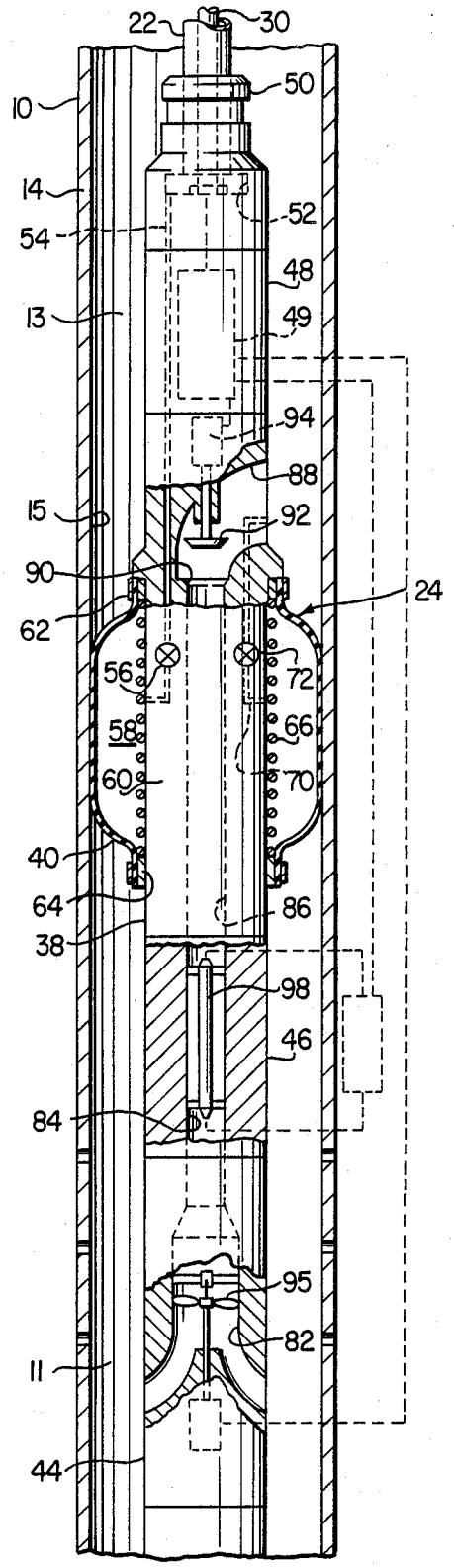
FIG. 2 is an elevation of the flow measuring or production logging instrument, partially sectioned to show certain features thereof.

Referring now to FIG. 2, further details of the instrument 24 are illustrated with the packer 38 shown in the actuated or sealing condition of the sleeve member 40. The instrument 24 includes an upper head portion 50 which is connected to the lower distal end of the tubing 22 and is provided with a conventional fishing neck configuration for retrieval of the instrument 24 in the unlikely event of separation of the tubing from the instrument in the wellbore. The tubing 22 terminates within the head portion 50 and opens into an internal passage 52 which is in communication with a conduit or passage 54 extending within the instrument 24 through the section 48 to the packer 38 and within the packer to a control valve 56. The valve 56 may be remotely controlled to conduct pressure fluid from the tubing 22 through the passages 52 and 54 to a chamber 58 formed between a generally cylindrical housing 60 of the packer 38 and the flexible sleeve member 40. In a preferred embodiment of the present invention, and similar to the construction of the packer described in U.S. Pat. No. 4,787,446, the member 40 comprises an elastomeric tubular sleeve disposed on the exterior of the housing 60 in surrounding relationship thereto and defining the chamber 58 between itself and the exterior of the housing 60. One end of the sleeve 40 is secured to the housing 60 by suitable clamp means 62 and the other end of the sleeve is suitably secured to a sliding ring or piston member 64. A coil spring 66 is disposed around the housing 60 and is operable to engage the piston 64 to urge the sleeve 40 to retract away from engagement with the wall surface 15 of the casing 14.

As further shown in FIG. 2, the chamber 58 is also in communication with a passage 70 formed in the housing 60, which passage has interposed therein a remotely controllable valve 72 for communicating the chamber 58 with the space 13. The valves 56 and 72 are suitably controlled by remotely controllable actuators, not shown, and which may be similar in construction and operation to the actuator shown for the valve described in conjunction with the apparatus in U.S. Pat. No. 4,787,446. The valves 56 and 72 may be configured as one multiple position valve member as described in the aforementioned patent.

Referring still further to FIG. 2, the flowmeter section 44 includes a flow passage 82 formed therein which opens into the space 11 and is in communication with a central passage 84 formed in the measurement section 46. The passage 84 is, in turn, in communication with a central passage 86 formed in the packer 38 and which opens into a discharge passage 88 at a shutoff valve seat 90 which may also be formed in the housing 60. The passage 88 opens into the space 13 for communicating wellbore fluid from the space 11 by way of the passages 82, 84 and 86. Under certain operating conditions of the instrument 24, it is desirable to shut off the flow of fluid through the passages 82, 84 and 86 by closure of a shutoff valve 92 which is adapted to engage the seat 90 and is operable to be moved between an open and closed position by a suitable remotely controllable actuator 94. The actuator 94 may be of a type which is electrically or pressure fluid operated and an alternate embodiment of the actuator 94 will be described in conjunction with FIG. 3.

The flowmeter section 44 is provided with a suitable flowmeter which may be of a turbine or propeller type and designated by the numeral 95 for measuring the total flow of the fluid composition being produced from the space 11. The flowmeter 95 may be of conventional construction and similar to that described in the publication "Production Logging—The Key to Optimum Well Performance" as referenced hereinabove. After the fluid passes through the flowmeter section 44, it enters the measurement section 46 which may be characterized by a conductor element 98 extending through the passage 84 and comprising a microwave transmission wave guide whereby the transmissivity of microwave energy through the measurement section 46 may be correlated with the composition of the fluid flowstream. Alternatively, a fluid composition determining or so-called water cut meter may be provided of a type which measures the dielectric constant of the fluid flowing through the measurement section 46.

The measurement section 46 may be similar to the so-called described in U.S. patent application Ser. No. 06/932,068 filed Nov. 18, 1986 in the name of Bentley N. Scott et al and assigned to the assignee of the present invention. The measurement section 46 may include other fluid property measurement devices, not shown, including a densimeter of the type described in the aforementioned publication of the Society of Petroleum Engineers. Signals generated by the measurement sections 44 and 46 may be transferred to a suitable control module 49 disposed in the instrument section 48 for recording information concerning the flow characteristics and properties of the fluid passing through the passages 82, 84, 86. Moreover, suitable signals may be transferred from the module 49 to the actuator 94 for operating the valve 92 automatically to close under excessively high flow conditions. The valve 92 may also be operated at will by signals transmitted from the control unit 32.

The operation of the instrument 24 is believed to be understandable to those of ordinary skill in the art from the foregoing description. However, briefly, when it is desired to measure the flow characteristics and/or certain properties of fluids being produced within the wellbore 10, the instrument 24 may be inserted into the wellbore and traversed to a desired location while connected to the tubing 22 as it is dereeled from and reeled onto the injection unit 26 in a known manner. When the instrument 24 is being traversed through the casing 14, the packer sleeve 40 is in a position retracted away from the wall surface 15 to permit free movement of the instrument. During movement of the instrument 24, it is usually desirable to prevent fluid flow through the passages 82, 84 and 86 and, accordingly, the shutoff valve 92 may be actuated to be in a closed position in engagement with the seat 90. The chamber 58 is exhausted by opening the valve 72 to permit flow of fluid out of the chamber 58 into the wellbore when it is desired to retract the sleeve 40 away from the casing wall. The sleeve 40 is in a retracted position initially when the instrument 24 is inserted into the wellbore.

When the instrument 24 is moved to a desired position in the wellbore, the valve 72 is closed and the valve 56 opened while pressure fluid is pumped through the tubing 22 to effect extension or inflation of the sleeve 40 into effective sealing engagement of the casing wall whereby the wellbore space 11 is prevented from direct communication with the space 13 and flow of fluid through the wellbore 10 from the desired interval of the formation 12 to be measured is required to pass through the passages 82, 84 and 86 once the valve 92 has been opened. When it is desired to move the instrument 24, the valve 56 is closed and the valve 72 opened to permit exhaustion of fluid from the chamber 58 and retraction of the packer sleeve 40 under the urging of spring 66. Thanks to the provision of fluid from the tubing string 22, the pressure in the chamber 58 may be easily controlled and a clean, uncontaminated liquid or gaseous fluid may be used in controlling the operation of the packer 38. Moreover, the signals generated by the flowmeter section 44 and the measurement section 46 may be transferred to the module 49 or communicated directly to conductors in the cable 30 for transmission to the control and information gathering unit 32 at the earth's surface.

Figure 3:
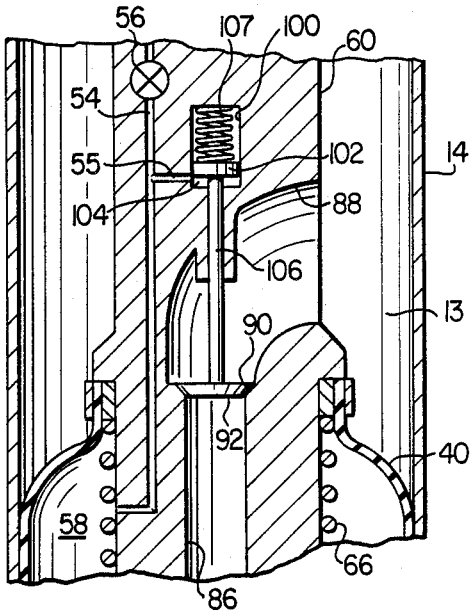
FIG. 3. is a detail section view of a modification of the wellbore flow shutoff valve and actuator for the instrument of the present invention.

Referring now to FIG. 3, an alternate embodiment of an actuator arrangement for the shutoff valve 92 is illustrated. In the embodiment of FIG. 3, the housing 60 of the packer 38 has been modified to provide an actuator 100 comprising a piston 102 disposed in a chamber 104 and connected to an actuating rod 106 for the closure member 92. A modified passage 54 is connected to a branch conduit 55 which opens into the chamber 104. The control valve 56 is interposed in the passage 54 between the branch passage 55 and the chamber 52 from which it receives pressure fluid from the tubing string 22.

In the embodiment illustrated in FIG. 3, the shutoff valve 92 is suitably biased into the closed position by means such as a spring 107 acting on the piston 102 and the piston is responsive to the introduction of pressure fluid into the chamber 104 to effect movement of the valve 92 to the open position in response to introduction of pressure fluid to the chamber 58. Accordingly, with the modified arrangement of FIG. 3, the shutoff valve 92 is automatically actuated to open in response to activation of the packer sleeve 40 to form a fluid tight seal in the wellbore, and the valve is closed when the packer 38 is deflated. The valve 92 may also be fluid operated and independently controlled by the placement of a control valve in the branch passage 55, for example.

A production logging instrument in accordance with the present invention may be constructed using several components which are presently commercially available and utilizing engineering materials that are normally used for well logging equipment. Although preferred embodiments of the present invention have been described in some detail herein, those skilled in the art will recognize that various substitutions and modifications may be made to the invention without departing from the scope and spirit thereof as set forth in the appended claims.

What we claim is:

1. An instrument for insertion into a wellbore for determining at least one of the fluid flow rate and the composition of fluids being produced in the wellbore, said instrument being adapted to be inserted in the wellbore at the end of an elongated tubing string, said tubing string being adapted to conduct pressure fluid to said instrument, said instrument being characterized by: a first section including means for connecting said instrument to said tubing string and first passage means for receiving pressure fluid from said tubing string;

a second section including a portion of said first passage means and second passage means for conducting wellbore fluids from a first space in said wellbore to a second space in said wellbore;

fluid pressure actuated seal means on said instrument including means forming a chamber operable to be in receipt of pressure fluid from said tubing string for causing said seal means to move into substantially fluid tight engagement with a wall of said wellbore to form said first and second spaces in said wellbore;

valve means in communication with said first passage means and with said chamber for controlling the flow of pressure fluid to said chamber from said tubing string for causing said seal means to form said seal between said first space and said second space in said wellbore; and shutoff valve means interposed in said second passage means and operable at will for controlling the flow of wellbore fluid through said instrument.

2. The instrument set forth in claim 1, including:

valve means for conducting pressure fluid from said chamber to effect movement of said seal means away from sealing engagement with said wall.

3. The instrument set forth in claim 1, including:

actuator means for said shutoff valve including means responsive to conducting pressure fluid to said chamber for moving said shutoff valve from a closed position to an open position to permit flow of wellbore fluid through said second passage means.

4. The instrument set forth in claim 1, including:

means for measuring the flow rate of pressure fluid from said first space to second space through said second passage means.

5. The instrument set forth in claim 1, including:

means for measuring the composition of said fluid flowing from said first space to said second space through said second passage means.

6. The instrument set for the in claim 1 wherein:

said seal means includes and elongated flexible sleeve disposed on a housing member and forming with said housing member said chamber, said sleeve being responsive to the introduction of pressure fluid to said chamber to move radially away from said housing member toward said wall of said wellbore to form a substantially fluid tight seal in said wellbore between said first space and said second space.

7. An instrument for insertion into a wellbore for determining at least one of the fluid flow rate and the composition of fluids being produced in the wellbore, said instrument being adapted to be inserted in the wellbore at the end of an elongated tubing string, said tubing string being adapted to conduct pressure fluid to said instrument, said instrument being characterized by:

a first section including means for connecting said instrument to said tubing string and first passage means for receiving pressure fluid from said tubing string;

a second section including second passage means for conducting wellbore fluids from a first space in said wellbore to a second space in said wellbore;

seal means on said instrument including means forming a chamber operable to be in receipt of pressure fluid from said tubing string for causing said seal means to engage a wall of said wellbore to form said first and second spaces in said wellbore;

valve means for controlling the flow of pressure fluid between said chamber and said tubing string for causing said seal means to form said seal between said first space and said second space; and shutoff valve means interposed in said second passage and operable at will for controlling the flow of wellbore fluid through said instrument.

8. An instrument for insertion into a wellbore for determining at least one of the fluid flow rate and the composition of fluids being produced in the wellbore, said instrument being adapted to be inserted in the wellbore at the end of an elongated tubing string, said tubing string being adapted to conduct pressure fluid to said instrument, said instrument being characterized by:

a first section including means for connecting said instrument to said tubing string and first passage means for receiving pressure fluid from said tubing string;

a second section including second passage means extending therethrough for conducting wellbore fluids form a first space in said wellbore to a second space in said wellbore;

means for measuring the flow rate of pressure fluid from said first space to second space through said second passage means;

means for measuring the composition of said fluid flowing from said first space to said second space through said second passage means;

seal means on said instrument including means forming a chamber operable to be in receipt of pressure fluid from said tubing string for causing said seal means to engage a wall of said wellbore to form said first and second spaces in said wellbore;

means for controlling the flow of pressure fluid to said chamber from said tubing string for causing said seal means to form said seal between said first space and said second space in said wellbore; and shutoff valve means interposed in said second passage means and operable at will for controlling the flow of wellbore fluid through said instrument.

9. The instrument set forth in claim 8 wherein:

said seal means includes an elongated flexible sleeve disposed on said second section and forming with said second section said chamber, said sleeve being responsive to the introduction of pressure fluid to said chamber to move radially away from said housing means toward said wall of said wellbore to form a substantially fluid tight seal in said wellbore between said first space and said second space.

* * * * *